US011213880B2

(12) United States Patent
Kick-Rodenbücher et al.

(10) Patent No.: US 11,213,880 B2
(45) Date of Patent: Jan. 4, 2022

(54) PRODUCTION METHOD, PISTON BLANK, PISTON AND AXIAL PISTON MACHINE HAVING SAID PISTON

(71) Applicant: SCHAEFFLER TECHNOLOGIES AG & CO. KG, Herzogenaurach (DE)

(72) Inventors: Reinhard Kick-Rodenbücher, Nuremberg (DE); Lukas Kuhn, Erlangen (DE); Horst Hartmann, Aurachtal (DE)

(73) Assignee: Schaeffler Technologies AG & CO. KG, Herzogenaurach (DE)

( * ) Notice: Subject to any disclaimer, the term of this patent is extended or adjusted under 35 U.S.C. 154(b) by 0 days.

(21) Appl. No.: 16/643,532

(22) PCT Filed: Aug. 22, 2018

(86) PCT No.: PCT/DE2018/100729
§ 371 (c)(1),
(2) Date: Feb. 29, 2020

(87) PCT Pub. No.: WO2019/042495
PCT Pub. Date: Mar. 7, 2019

(65) Prior Publication Data

US 2020/0346278 A1 Nov. 5, 2020

(30) Foreign Application Priority Data

Aug. 31, 2017 (DE) ..... 10 2017 119 967.5

(51) Int. Cl.
*B21K 1/18* (2006.01)

(52) U.S. Cl.
CPC ..... *B21K 1/18* (2013.01); *B21K 1/185* (2013.01)

(58) Field of Classification Search
CPC ..... B21C 23/14; B21K 1/18; B21K 1/185; B23P 15/10; F02F 2003/0007;
(Continued)

(56) References Cited

U.S. PATENT DOCUMENTS 4,494,448 A * 1/1985 Eystratov ..... B21C 23/22 29/510
5,642,654 A * 7/1997 Parekh ..... B23P 15/10 92/172
(Continued)

FOREIGN PATENT DOCUMENTS

CN 1294036 A 5/2001
DE 3204264 A1 8/1983
(Continued)

OTHER PUBLICATIONS

Written Opinion of the International Searching Authority for International Application No. PCT/DE2018/100729 (Year: 2018).*

*Primary Examiner* — Christopher J Besler
(74) *Attorney, Agent, or Firm* — Rutan & Tucker LLP; Hani Z. Sayed

(57) ABSTRACT

A method of producing a piston blank, comprising producing an intermediate blank of a piston for an axial piston machine by extrusion wherein the intermediate blank includes a shaft portion, a ball head portion, and a sealing portion, wherein the shaft portion connects the ball head portion to the sealing portion. The method also includes producing a piston blank of the piston from the intermediate blank and machining a through-opening in the intermediate blank, wherein the through-opening extends within the piston blank in the longitudinal direction.

8 Claims, 3 Drawing Sheets

(58) Field of Classification Search
CPC ..... F02F 2200/04; F04C 2230/24; F04C 2230/25; F04C 2230/26; F04B 53/14; F04B 27/0878; F04B 1/124
See application file for complete search history.

(56) References Cited

U.S. PATENT DOCUMENTS

| | | | | |
|---|---|---|---|---|
| 6,662,709 | B1 * | 12/2003 | Beutler | F04B 1/124 29/888.042 |
| 2007/0125227 | A1 * | 6/2007 | Beck | F01B 3/0085 92/71 |
| 2008/0083326 | A1 * | 4/2008 | Brockerhoff | F04B 1/124 92/110 |

FOREIGN PATENT DOCUMENTS

| | | | |
|---|---|---|---|
| DE | 19934216 | A1 | 2/2001 |
| DE | 19938046 | A1 | 3/2001 |
| DE | 102004013181 | B3 | 9/2005 |
| DE | 102004061863 | A1 | 7/2006 |
| DE | 202007017659 | U1 | 4/2008 |
| DE | 102006060015 | A1 | 6/2008 |
| KR | 20120037241 | A | 4/2012 |

* cited by examiner

PRODUCTION METHOD, PISTON BLANK, PISTON AND AXIAL PISTON MACHINE HAVING SAID PISTON

CROSS-REFERENCE TO RELATED APPLICATIONS

This application is the U.S. National Phase of PCT/DE2018/100729 filed Aug. 22, 2018, which claims priority to DE 10 2017 119 967.5 filed Aug. 31, 2017, the entire disclosures of which are incorporated by reference herein.

TECHNICAL FIELD

The disclosure relates to a production method having the features of the preamble of claim 1. The disclosure further relates to a piston blank, to a piston and to an axial piston machine having said piston.

Axial piston machines which operate as a pump and/or as a motor are known. Such axial piston machines have a plurality of so-called axial pistons. The axial pistons are produced by machining, for example.

BACKGROUND

Document DE 10 2004 061 863 A1, which most likely describes the closest prior art, discloses a piston for a piston machine, in particular for an axial piston machine of oblique-axis construction, comprising a conical portion, a neck region and a ball head integrally formed on the neck region, a cavity formed in the piston, and a stem formed in the cavity. The document further discloses a method for producing the piston, wherein the method comprises the method steps of cutting off round material to a desired length, producing an inner contour by cold extrusion, preparing the outer contour by pre-turning, producing the outer contour by rotary swaging and finishing.

An object on which the disclosure is based is to propose a production method which is distinguished by cost-effective production of a piston blank or of a piston. It is a further object of the disclosure to propose a corresponding piston blank, a piston and an axial piston machine having said piston.

Another object is achieved by a production method, a piston blank, a piston, and an axial piston machine having the features of the disclosure below. Embodiments of the disclosure are disclosed in the following description and the figures.

SUMMARY

A subject of the disclosure is a production method which serves in particular for producing a piston blank for a piston and/or the piston. The piston blank may be an intermediate product and can be produced in further method steps to form a piston. The piston may be designed and/or suitable for an axial piston machine. With particular preference, the piston takes the form of an axial piston and/or the axial piston machine takes the form of an axial piston pump. Specifically, the axial piston machine is designed and/or suitable for a land machine. In particular, the axial piston machine takes the form of an axial piston motor, and can be integrated for example in a wheel hub of the land machine. The piston can be received and/or rectilinearly guided in a cylinder bore of the axial piston machine.

Within the context of the disclosure, it is proposed that, in a method step, which may be in a first method step, of the production method, an intermediate blank is produced by extrusion. In particular, for this purpose, a raw part, such as a solid body, is shaped by an extrusion tool. A shaft portion and/or a ball head portion and/or a sealing portion may be produced as a result of the extrusion, with the result that the intermediate blank is formed. In particular, a basic shape of the finished piston is created as a result of the extrusion. Optionally, an elevation which extends peripherally with respect to the main axis is created on the ball head portion as a result of the extrusion. The elevation is formed in particular as a result of volume compensation during the extrusion.

The intermediate blank has the shaft portion, the ball head portion and the sealing portion. The ball head portion serves in particular for articulated connection to a disk of the axial piston machine. The sealing portion serves in particular for receiving a sealer and/or for sealing the piston with respect to the cylinder bore. The shaft portion connects the ball head portion to the sealing portion. In particular, the ball head portion and the sealing portion are directly integrally formed on the shaft portion. The shaft portion defines a main axis with its longitudinal axis and/or its axis of symmetry. The sealing portion may be designed as a type of flange or collar which extends with respect to the main axis in the radial direction. The sealing portion and/or the ball head portion can have a larger outside diameter than the shaft portion. The shaft portion may have a conical or a cylindrical shape.

In a further method step, such as a second method step, of the production method, a piston blank is produced. For this purpose, a through-opening is incorporated in the intermediate blank by machining. The through-opening can be incorporated in the intermediate blank by a machining tool. The through-opening may be incorporated in the intermediate blank by milling or by drilling. For this purpose, the machining tool is moved with an advancing motion in the axial direction with respect to the main axis through the sealing portion, the shaft portion and the ball portion while the machining tool rotates.

The through-opening extends within the piston blank in the longitudinal direction. The through-opening may take the form of a through-bore and/or a longitudinal bore and/or a stepped bore. The through-opening may be arranged coaxially and/or concentrically to the main axis. The through-opening may extend in the axial direction with respect to the main axis between the ball portion and the sealing portion. In particular, the through-opening traverses the piston blank. The through-opening can serve for example as a hydraulic load relief.

The advantage of the disclosure consists in the fact that the complexity of the machining finishing to give the finished product, in particular the piston, is considerably reduced as a result of the extrusion of the intermediate blank. By virtue of the extrusion, the piston blank already has a high surface quality and a high component accuracy. Furthermore, a directed fiber orientation is established in the piston produced in the extrusion process and has a positive effect on the component properties, for example the component strength. A further advantage consists in the fact that the piston blank can be produced cost-effectively by the production method according to the disclosure.

In an implementation of the disclosure, an indentation is created in the ball head portion as a result of the extrusion. In particular, the indentation takes the form of a conical countersink. The indentation may be arranged coaxially and/or concentrically to the main axis. Specifically, the indentation is made on an axial end side of the ball head portion and may extend axially in the direction of the shaft portion.

The indentation forms an outlet for the through-opening. In particular, the through-opening is incorporated separately in the intermediate blank in a subsequent machining process. The indentation may have a larger diameter than the through-opening, with the result that the indentation may form a bevel at the through-opening. With particular preference, the through-opening of the piston blank may open within the indentation. This ensures that no burr arises or is present on the axial end side of the ball head portion.

In another embodiment of the disclosure, a recess is created in the sealing portion as a result of the extrusion. The recess serves in particular for reducing the weight of the piston. The shape of the intermediate blank and also the recess and/or the indentation may be created in one process step. In particular, the recess takes the form of a conical and/or a cylindrical and/or a concave and/or a hemispherical depression. The recess may be arranged coaxially and/or concentrically to the main axis. Specifically, the recess is made on an axial end side of the sealing portion and may extend axially in the direction of the shaft portion.

The recess forms an inlet for the through-opening. The recess may have a larger diameter than the through-opening. With particular preference, the through-opening is incorporated in the intermediate blank in a bottom region of the recess. The advantage of the recess may include the fact that a smaller mass has to be moved in the subsequent application by virtue of the recess. In particular the operating behavior of the axial piston machine can be improved as a result.

In a further implementation, a surface of the shaft portion with near-final contour is created on the intermediate blank as a result of the extrusion. In particular, the surface with near-final contour is formed by a lateral surface of the shaft portion. Alternatively or optionally in addition, the surface with near-final contour is formed by a transition region between the shaft portion and the sealing portion and/or between the shaft portion and the ball head portion. The transition region may take the form of a radius and/or a cone by which the shaft portion transitions into the ball head portion and/or the sealing portion.

Alternatively or optionally in addition, an end face of the sealing portion with near-final contour is created. In particular, the end face with near-final contour is formed with respect to the main axis by an axial end face of the sealing portion. The end face may take the form of a circular ring face.

In particular, a surface quality of the surface or end face with near-final contour is created as a result of the extrusion that corresponds to the surface requirements of the finished piston. Consequently, the surface or end face with near-final contour does not need to be finished in the further machining processes, with the result that the production costs of the piston are considerably reduced. Furthermore, the surface nature of the faces with near-final contour and the fiber orientation within the piston blank or the piston form clear identification features for a piston produced by extrusion.

In a further embodiment, a spherical segment geometry is created on a circumferential face of the sealing portion on the intermediate blank or on the piston blank by machining. The spherical segment geometry particularly prevents the piston from wedging in the cylinder bore of the axial piston machine. The spherical segment geometry may take the form of a rotationally symmetrical lateral surface of a ball segment. With particular preference, the spherical segment geometry is produced by turning. Specifically, the spherical segment geometry and the through-opening are created in a common machining process.

In a further concrete form of the disclosure, a piston is produced in a further method step. In particular, the piston takes the form of the axial piston for the axial piston machine. The piston is produced by finishing the piston blank. The finishing may serve for changing the material properties and/or the geometric properties and/or the surface quality of the piston blank, with the result that the piston is formed.

In a concrete implementation, the piston blank is hardened in a first substep of the further method step. In particular, a tolerance compensation, for example an expansion or a change in dimension of the piston blank as a result of the hardening process, is already taken into account during the production of the intermediate blank. The extrusion tool may be designed in a corresponding manner to the tolerance compensation. The faces which do not have to be finished, such as the surface of the shaft portion with near-final contour and/or the end face of the sealing portion with near-final contour, may have an undersize, with the result that the faces which do not have to be finished correspond to the final contour after the hardening process.

In further substeps, the ball geometry of the ball head portion and the spherical segment geometry of the sealing portion are machined. The spherical segment geometry and the ball geometry are may be machined in a common machining process. Alternatively, the spherical segment geometry and the ball geometry are machined in two separate machining processes. In particular, the ball geometry and/or the spherical segment geometry are/is machined by hard turning and/or by grinding and/or by superfinishing. For example, the peripheral elevation of the ball head portion is removed. For example, at least one groove which extends peripherally with respect to the axis of rotation is incorporated in the sealing portion to receive the sealer.

A further subject of the disclosure relates to a piston blank as disclosed below or as has been described above. The piston blank is extruded and has the shaft portion, the ball head portion and the sealing portion, wherein the shaft portion connects the ball head portion to the sealing portion. Furthermore, the piston blank has the through-opening incorporated by machining, wherein the through-opening extends within the piston blank in the longitudinal direction. Alternatively or optionally in addition, the piston blank is produced by the production method as has already been described above. Optionally in addition, the piston blank can have the indentation and/or the recess and/or the spherical segment geometry and/or the surface of the shaft portion with near-final contour and/or the end face of the sealing portion with near-final contour.

A further subject of the disclosure relates to a piston as claimed in one of the preceding claims or as has been described above. The piston is designed and/or suitable for an axial piston machine. The piston is hardened. In particular, the surface of the shaft portion and/or the end face of the sealing portion correspond to the final contour of the piston after the hardening process. The ball geometry of the ball head portion and also the spherical segment geometry of the sealing portion are machined. Alternatively or optionally in addition, the piston blank is produced by the production method as has already been described above. Optionally in addition, the piston can have the indentation and/or the recess and/or the spherical segment geometry.

A further subject of the disclosure relates to an axial piston machine having the piston as claimed in one of the preceding claims or as has been described above. The piston takes the form of an axial piston. In particular, the axial piston machine takes the form of an axial piston pump or an axial piston motor. The axial piston pump in particular converts mechanical energy into hydraulic energy. The axial piston motor in particular converts hydraulic energy into mechanical energy. These axial piston machines can comprise a housing in which a rotor and a disk each rotates about an axis of rotation, wherein the two axes of rotation form an angle, with the result that the rotor is angled relative to the disk. The rotor has in each case one or more cylinder bores for receiving the piston. The piston is, on the one hand, articulated with the disk, for example via a ball head, and, on the other hand, received in a guided manner in the receptacle of the piston. When the rotor rotates with respect to the housing, each piston moves axially in the receptacle. The axial piston machine may take the form of an oblique-axis machine or a swashplate machine or a wobble-plate machine. In particular, the axial piston machine has more than two, preferably more than four, especially more than eight, of the pistons. The axial piston machine may have an uneven number of pistons.

BRIEF DESCRIPTION OF THE DRAWINGS

Further features, advantages and effects of the disclosure will emerge from the following description of exemplary embodiments of the disclosure. In the drawings.

DETAILED DESCRIPTION

Figure 1:
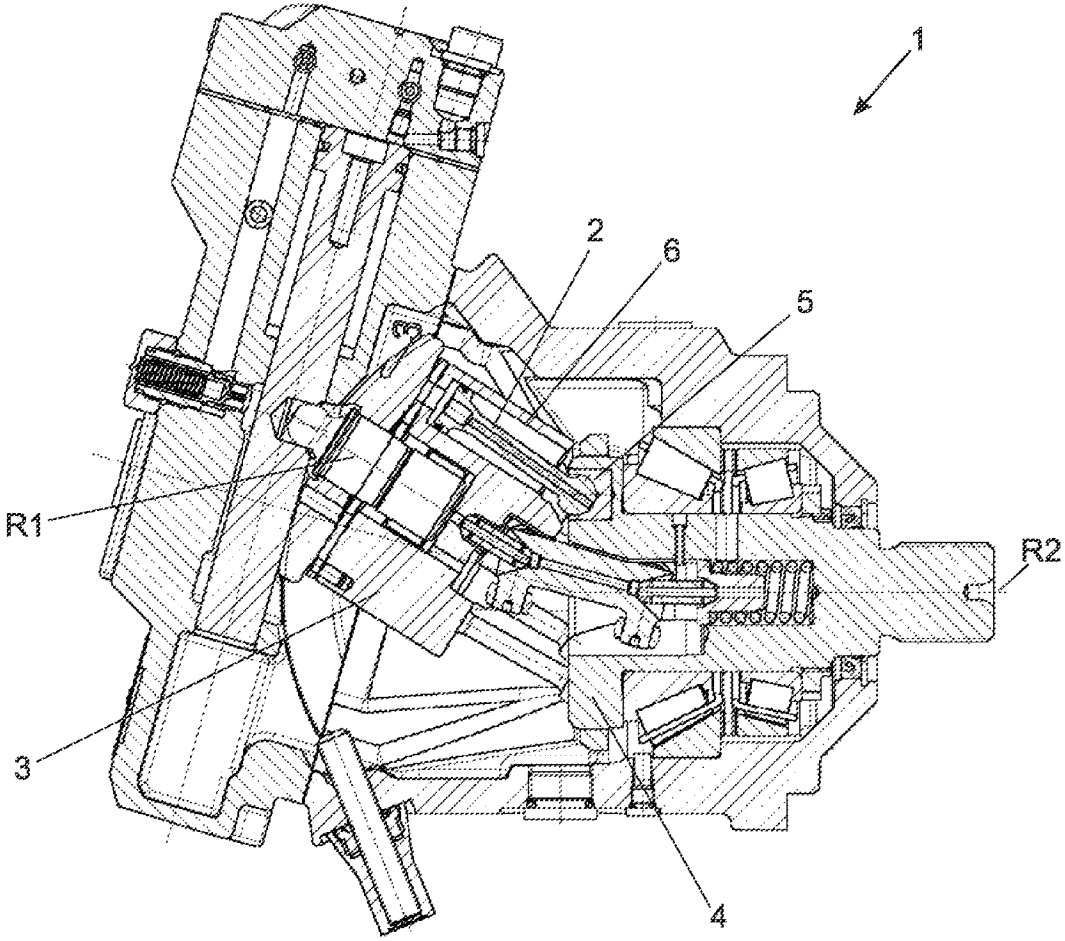
FIG. 1 shows in a sectional illustration an axial piston machine having an axial piston as one exemplary embodiment of the disclosure.

FIG. 1 shows in a sectional illustration an axial piston machine 1 which is designed and/or suitable for example for an agricultural or construction machine. The axial piston machine 1 takes the form of an oblique-axis pump which may convert mechanical energy into hydraulic energy. The axial piston machine 1 has a plurality of pistons 2, a rotor 3 and a disk 4. The axial piston machine 1 has for example nine of the pistons 2, wherein the pistons 2 take the form of axial pistons. The pistons 2 are connected to the disk 4 in an articulated manner via a ball joint 5.

The rotor 3 rotates during operation of the axial piston machine 1 about a first axis of rotation R1. The rotor 3 takes the form of a piston housing and has for this purpose a plurality of cylinder bores 6, wherein each piston 2 is movably arranged in one of the cylinder bores 6 and is rectilinearly guided in the axial direction with respect to the axis of rotation R. The cylinder bores 6 are arranged so as to be uniformly spaced apart from one another about the axis of rotation R.

The disk 4 rotates during operation of the axial piston machine 1 about a second axis of rotation R2, wherein the first and the second axis of rotation R1, R2 intersect, with the result that the rotor 3 is arranged at an angle relative to the disk 4. A rotation of the disk 4 causes the pistons 2 to be moved back and forth in the cylinder bores 6, with the result that they deliver a hydraulic fluid, for example.

Figure 2:
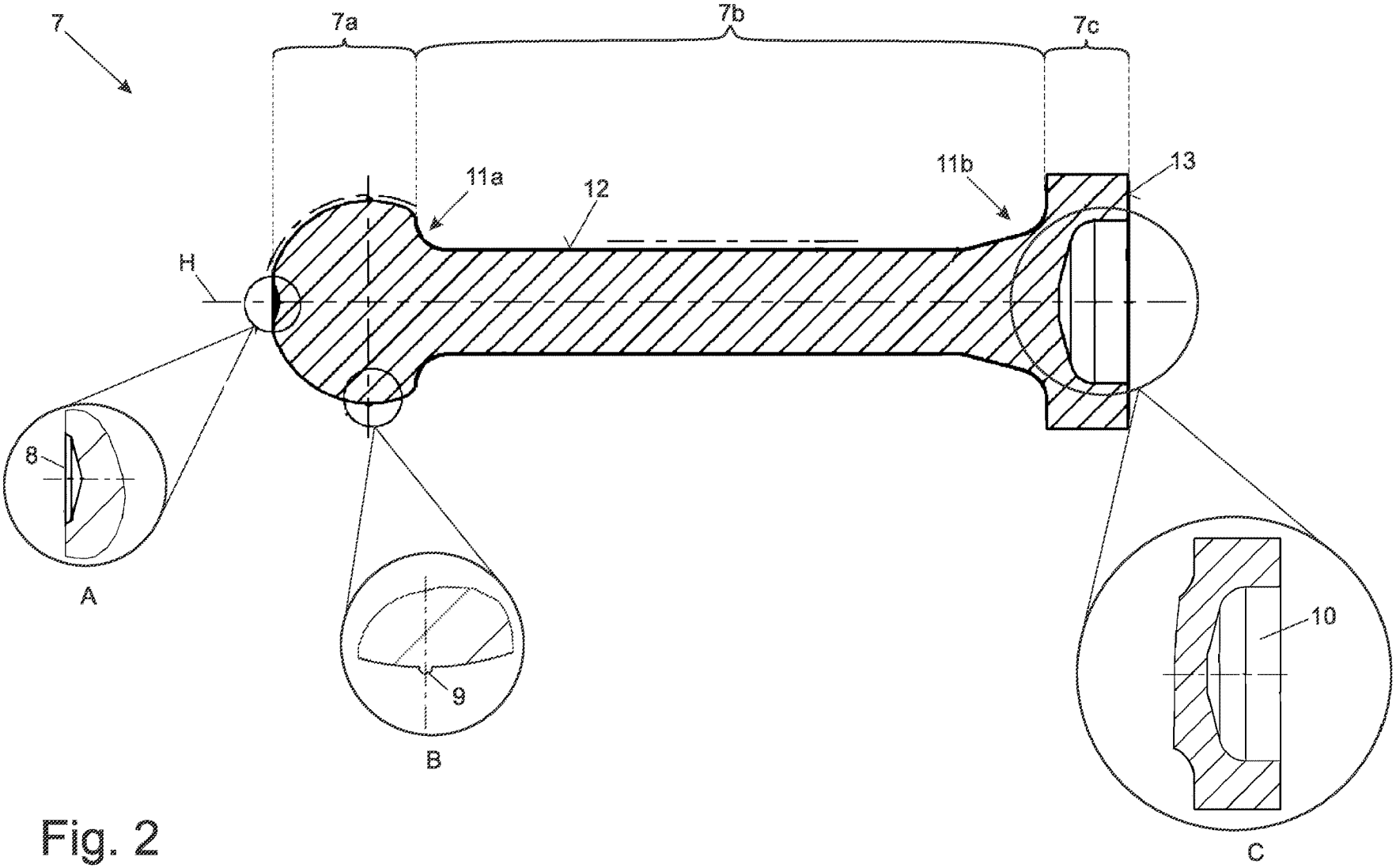
FIG. 2 shows in a sectional illustration an intermediate blank of the piston from FIG. 1.

FIG. 2 shows an intermediate blank 7 of the piston 2 from FIG. 1, in a longitudinal section along a main axis H. The intermediate blank 7 is produced for example from a raw part, for example from a solid material of round cross section, by extrusion with an extrusion tool. For example, the extrusion tool comprises a punch and a die. The intermediate blank 7 has a ball head portion 7*a*, a shaft portion 7*b* and a sealing portion 7*c*. The shaft portion 7*b* connects the ball head portion 7*a* and the sealing portion 7*c* directly to one another, with the intermediate blank 7 being extruded.

The ball head portion 7*a* has an elevation which extends peripherally about the main axis H and which is illustrated in the detail view B. For example, the die of the extrusion tool has a peripheral groove which serves for volume compensation for excess material. The raw part has for example a small oversize, with it being possible during the extrusion for the excess material to escape into the groove of the die such that the elevation 9 is formed.

The sealing portion 7*c* takes the form of a peripheral collar with respect to the main axis H and extends radially outward. The sealing portion 7*c* has a recess 10 which is illustrated in the detail view C. The recess 10 takes the form of a cylindrical countersink with an inwardly curved bottom region. The recess 10 is arranged coaxially and/or concentrically to the main axis H on an axial end side of the sealing portion 7*c*. The recess 10 serves for reducing the weight of the piston 2 and for this purpose extends over for example more than 60%, preferably more than 70%, especially more than 80%, of the end face of the sealing portion 13. The indentation 8, the elevation 9 and the recess 10 can be produced jointly as a result of the extrusion in one process step together with the shaping of the intermediate blank 7.

The shaft portion 7*b* has a cylindrical shape, with the shaft portion 7*b* being connected to the ball head portion 7*a* in a first transition region 11*a* via a radius. In a second transition region 11*b*, the shaft portion 7*b* is connected to the sealing portion 7*c* via a conical widening extending in the direction of the sealing portion 7*c* and via a further radius. The first and the second transition region 11*a, b* and also the lateral surface of the cylindrical form a surface 12 of the shaft portion 7*b* with near-final contour.

The ball head portion 7*a* has an indentation 8 which is illustrated in the detail view A. The indentation 8 takes the form of a conical countersink and is arranged coaxially and/or concentrically to the main axis H on an axial end side of the ball head portion 7*a*.

The sealing portion 7*c* has on its axial end side, with respect to the main axis H, an end face 13 with near-final contour. The end face 13 takes the form of a circular ring face and is delimited by the recess 10 in the radial direction. The surface 12 with near-final contour and the end face 13 with near-final contour are created as a result of the extrusion and have, for example, the final contour of the finished piston 2 after the extrusion process. The surface 12 and the end face 13 may have a sufficiently high surface quality and/or component accuracy already after the extrusion, with the result that the surface 12 and the end face 13 no longer have to be finished.

Figure 3:
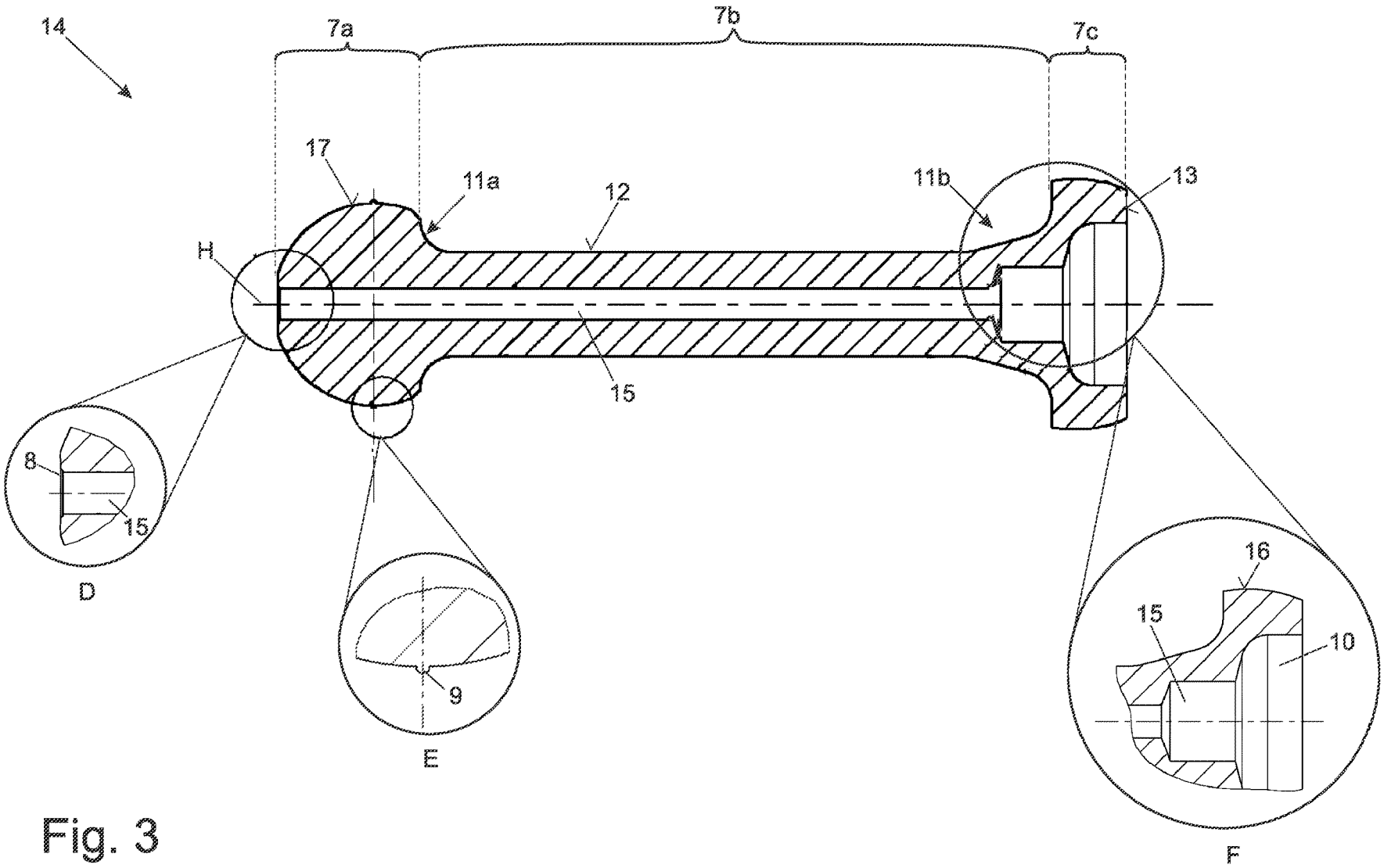
FIG. 3 shows in a sectional illustration a piston blank of the piston from FIG. 1.

FIG. 3 shows a piston blank 14 of the piston 2 from FIG. 1, in a longitudinal section along the main axis H. The piston blank 14 has a through-opening 15 which extends within the piston blank 14 in the axial direction with respect to the main axis H. To produce the piston blank 14, the through-opening 15 is incorporated in the intermediate blank 7 by machining. The through-opening 15 is arranged coaxially and/or concentrically to the main axis H. The through-opening 15 takes the form of a stepped through-bore and extends in the direction of the indentation 8 starting from the recess 10. Here, the recess 10 forms an inlet for the through-opening 15, and the indentation 8 forms an outlet for the through-opening 15. The through-opening 15 opens within the indentation 8 or in the region of a bevel of the indentation 8, as illustrated in the detail view D. This ensures that no burr occurs on the end side of the ball portion 7*a* through the bore outlet.

The sealing portion 7*c* has a spherical segment geometry 16, which is illustrated in the detail view F, on a circumferential face. The spherical segment geometry 16 serves for example to prevent the piston 2 wedging in the piston receptacle 6. For this purpose, the circumferential face of the sealing portion 7*c* of the intermediate blank 7 is machined such that the spherical segment geometry 16 is created. For example, the through-bore 15 and the spherical segment geometry can be created on the intermediate blank 7 in a common machining process such that the piston blank 14 is formed.

To produce the piston 2, the piston blank 14 is for example hardened before the ball portion 7*a*, in particular a ball geometry 17, and the sealing portion 7*c*, in particular the spherical segment geometry 16, are machined to the final contour. For example, the ball geometry 17 and the spherical segment geometry 16 are machined in a finishing process by a hard-turning, grinding and/or superfinishing process. Here, for example, the elevation 9 is removed and/or a sealer receptacle, which is designed for example to receive at least one piston ring, is incorporated in the region of the spherical segment geometry 16.

An expansion or a change in dimension of the piston blank 14 by the hardening process is already taken into account in the design of the extrusion tool. The extrusion tool or the extrusion process is correspondingly optimized such that all contours and dimensions which do not have to be finished, in particular the surface 12 with near-final contour and the end face 13 with near-final contour, correspond to the final contour after a hardening process.

LIST OF REFERENCE SIGNS

1 Axial piston machine
2 Piston
3 Rotor
4 Disk
5 Ball joint
6 Cylinder bore
7 Intermediate blank
7*a* Ball head portion
7*b* Shaft portion
7*c* Sealing portion
8 Indentation
9 Elevation
10 Recess
11*a* First transition region
11*b* Second transition region
12 Surface with near-final contour
13 End face with near-final contour
14 Piston blank
15 Through-opening
16 Spherical segment geometry
17 Ball geometry
A-F Detail views
H Main axis
R1 First axis of rotation
R2 Second axis of rotation

The invention claimed is:

1. A production method, wherein the production method comprises the following method steps:

producing an intermediate blank of a piston for an axial piston machine by extrusion, wherein the intermediate blank has a shaft portion, a ball head portion and a sealing portion, wherein the shaft portion connects the ball head portion to the sealing portion, wherein the ball head portion includes an indentation and the sealing portion includes a recess, wherein the ball head portion includes a larger outside diameter than the shaft portion; and producing a piston blank of the piston from the intermediate blank, wherein a through-opening is incorporated in the intermediate blank by machining, wherein the through-opening extends within the piston blank in a longitudinal direction, wherein the indentation at the piston blank forms an outlet for the through-opening;

wherein the recess and the indentation are created on the intermediate blank as a result of the extrusion, wherein the recess forms an inlet for the through-opening and the sealing portion includes a flange or collar extending with respect to a main axis in a radial direction, wherein the main axis is defined via a longitudinal axis along the shaft portion, wherein the sealing portion includes a larger diameter than the shaft portion.

2. The production method of claim 1, wherein a surface of the shaft portion with near-final contour and an end face of the sealing portion with near-final contour is created on the intermediate blank as a result of the extrusion.

3. The production method of claim 1, wherein a spherical segment geometry is created on a circumferential face of the sealing portion on the intermediate blank or on the piston blank by machining.

4. The production method of claim 1, wherein the piston is produced in a further method step, wherein the piston is produced by finishing the piston blank.

5. The production method as claimed in claim 4, wherein the finishing of the piston blank comprises the following substeps:

hardening the piston blank;

machining a ball geometry of the ball head portion;

machining a spherical segment geometry of the sealing portion.

6. The production method of claim 1, wherein the ball head portion includes an elevation which extends peripherally with respect to a main axis defined via a longitudinal axis along the shaft portion, as a result of the extrusion, wherein the elevation is formed as a result of volume compensation during the extrusion.

7. The production method of claim 1, wherein the shaft portion is connected to the ball head portion via a first transition region via a radius.

8. The production method of claim 7, wherein a second transition region is formed where the shaft portion is connected to the sealing portion via a conical widening extending in the direction of the sealing portion and via a further radius.

* * * * *